US009303366B2

(12) United States Patent
Downing

(10) Patent No.: US 9,303,366 B2
(45) Date of Patent: Apr. 5, 2016

(54) ACCESS MAT

(71) Applicant: Structurlam Products Ltd., Penticton (CA)

(72) Inventor: William Downing, Penticton (CA)

(73) Assignee: Structurlam Products Ltd., Penticton, BC (CA)

( * ) Notice: Subject to any disclaimer, the term of this patent is extended or adjusted under 35 U.S.C. 154(b) by 0 days.

(21) Appl. No.: 14/625,655

(22) Filed: Feb. 19, 2015

(65) Prior Publication Data

US 2015/0233065 A1 Aug. 20, 2015

Related U.S. Application Data

(60) Provisional application No. 61/943,523, filed on Feb. 24, 2014.

(30) Foreign Application Priority Data

Feb. 20, 2014 (CA) ..... 2843105

(51) Int. Cl.
*E01C 9/00* (2006.01)
*E01C 9/08* (2006.01)

(52) U.S. Cl.
CPC ..... *E01C 9/086* (2013.01); *E01C 2201/12* (2013.01)

(58) Field of Classification Search
CPC ..... E01C 9/086; E01C 2201/12
USPC ..... 404/36, 45, 46
See application file for complete search history.

(56) References Cited

U.S. PATENT DOCUMENTS

| | | | | |
|---|---|---|---|---|
| 3,202,067 | A | 8/1965 | Michard et al. | |
| 3,348,549 | A | 10/1967 | Brodmann et al. | |
| 3,679,531 | A | 7/1972 | Wienand et al. | |
| 4,462,712 | A * | 7/1984 | Penland, Sr. | E01C 9/086 404/36 |
| 4,594,829 | A | 6/1986 | Herrgord | |
| 4,973,505 | A | 11/1990 | Bielous | |
| 5,032,037 | A | 7/1991 | Phillips et al. | |
| 5,050,362 | A | 9/1991 | Tal et al. | |
| 5,087,149 | A * | 2/1992 | Waller, Jr. | E01C 9/086 404/35 |
| 5,098,218 | A | 3/1992 | Reese et al. | |
| 5,204,149 | A | 4/1993 | Phenicie et al. | |
| 5,215,802 | A | 6/1993 | Sijpesteijn | |
| 5,810,511 | A | 9/1998 | Schmidt | |
| 5,833,386 | A | 11/1998 | Rosan et al. | |
| D402,063 | S | 12/1998 | Dickey | |
| 5,971,655 | A | 10/1999 | Shirakawa | |
| 6,021,646 | A | 2/2000 | Burley et al. | |
| 6,260,828 | B1 | 7/2001 | English | |
| 6,324,796 | B1 | 12/2001 | Heath | |
| 6,652,183 | B2 | 11/2003 | Stasiewich et al. | |
| 6,733,206 | B2 | 5/2004 | Stasiewich et al. | |

* cited by examiner

*Primary Examiner* — Raymond W Addie
(74) *Attorney, Agent, or Firm* — Davis & Bujold PLLC; Michael J. Bujold

(57) ABSTRACT

An access mat having a rectangular body with a length dimension and a width dimension. The body includes three laminated layers of lumber, with each of the lumber having a longitudinal axis. A first layer of the three layers has a plurality of lumber, with the longitudinal axis of each lumber in a parallel orientation extending across the length dimension. A second layer of the three layers has a plurality of lumber with the longitudinal axis of each lumber in a parallel orientation extending across the width dimension. A third layer of the three layers has a plurality of lumber with the longitudinal axis of each lumber in an angular orientation relative to the longitudinal axis of the plurality of lumber of the second layer. Connectors are provided for connecting the body with other like bodies.

12 Claims, 5 Drawing Sheets

ACCESS MAT

FIELD

There is described an access mat to allow access to environmentally sensitive areas, these access mats are also referred to by various other names such as: "rig mats", "road mats", "site mats" or "swamp mats".

BACKGROUND

The standard that other access mats are measured against are lumber access mats that use 160 to 200 bolts to secure the lumber together. There have been numerous attempts to replace the bolted lumber access mats with other forms of mats. To date the alternative mats have not been successful in supplanting bolted lumber access mats. There will hereinafter be described an alternative form of access mat.

SUMMARY

There is provided an access mat has a rectangular body having a length dimension and a width dimension. The body includes three laminated layers of lumber, laminated together by pressure and adhesive, with each of the lumber having a longitudinal axis. A first layer of the at least three layers has a plurality of lumber, with the longitudinal axis of each lumber in a parallel orientation extending across the length dimension. A second layer of the three layers has a plurality of lumber with the longitudinal axis of each lumber in a parallel orientation extending across the width dimension. A third layer of the three layers has a plurality of lumber with the longitudinal axis of each lumber in an angular orientation relative to the longitudinal axis of the plurality of lumber of the second layer. Connectors are provided for connecting the body with other like bodies.

This cross-laminated lumber access mat was tested against bolted lumber access mat and, as will hereinafter be described, substantially out-performed the bolted lumber access mat. It is, of course, possible to fabricate a cross-laminated access mat having just two layers or more than three layers. A cross-laminated access mat having just two layers is not believed to have the requisite strength and stiffness. It would not be practical given the loads and abuse to which it would be subjected. A cross-laminated access mat having more than three layers would be viable, but each layer increase weight and at some point additional layers would tend to be redundant.

It is preferred that the longitudinal axis of each lumber of the plurality of lumber of the second layer is in an orientation that is perpendicular to the orientation of the lumber of the first layer. It is also preferred that the longitudinal axis of each lumber of the plurality of lumber of the third layer is in an orientation that is perpendicular to the orientation of the lumber of the second layer. It will be appreciated that another angular orientation, such as 45 degrees, would be viable. However, diagonal orientations would tend to reduce the strength of the body and result in a waste of materials during manufacture.

To facilitate lamination, it is preferred that the plurality of lumber of the first layer and the plurality of lumber of the second layer be closely spaced. However, it should be noted that it is preferred that the plurality of lumber of the third layer be are spaced farther apart. The reason for this is that it was discovered that removal of the access mats from wet and swampy areas could be problematic due to water adhesion. Having the lumber of the third layer spaced apart serves to relieve surface tension of the water. It also reduces the weight of the body, as fewer lumber are used.

There are various types of connectors that are well known for access mats. The form of connectors used is not critical to obtaining beneficial results from the access mat. The preferred form of connector, which will hereinafter be further described, is positioned at the ends of the body. The body has a first end and a second end. One of the connectors is a series of projecting tongues at one of the first end or the second end. Another of the connectors is a series of recessed tongue receivers at another of the first end or the second end. Each of the tongues of one access mat engage one of the tongue receivers of another access mat to connect the body with other like bodies. Some access mats connect at both the sides and the ends. These access mats are only intended to connect at their respective ends. The sides are allowed to "float" without connection. It will be appreciated that side connectors could be added, if desired or if the application required such side connectors.

One innovation in relation to the connectors is having each of the projecting tongues secured to the body by removable fasteners. This is very useful as it enables projecting tongues to be removable to facilitate replacement of damaged tongues. If the projecting tongues could not be replaced, damage to the projecting tongues could render the access mat useless as it could no longer connect with other access mats.

It is preferred that each of the projecting tongues and tongue receivers are positioned in the third layer. The third layer is the bottom layer. When the projecting tongues and tongue receivers are positioned in the bottom layer, the first layer (which is the top layer and the travel surface) is free from any obstruction which might catch during snow removal, serve to accumulate mud or otherwise interfere with movement along the travel surface.

At some sites, the access mats are positioned using a piece of equipment referred to as a "button top grapple". The button top grapple is a tracked vehicle that uses pinchers having sharp teeth to grab the mats one each side. Each layer has a peripheral side edge. It is preferred that the peripheral side edge of the second layer extend outwardly past the peripheral side edge of the first layer and the third layer. The teeth of the pinchers on the button top grapple engage these peripheral side edge projections, and this protects the first layer and the third layer from sustaining damage to their respective peripheral side edges.

At other sites, the access mats are handled by fork lifts. Fork lift engagements, can sometimes cause corner damage. It is, therefore, preferred that metal elements be positioned at each corner of the body to protect the body from corner damage. The metal elements can be as simple as some bolts strategically positioned in the corners, where fork lift impact may occur.

Environmental disposal of access mats can be a problem. Especially bolt lumber access mats which may have welded metal frames and 160 to 200 bolts. Apart from the fasteners securing the projecting tongues and the metal elements protecting each corner of the body (optional features which may or may not be included in a customer's order), the body of the cross-laminated access mat has no metal components. Upon removal of the fasteners securing the projecting tongues and the metal elements protecting each corner of the body, the body can be disposed of on-site through chipping and spreading.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
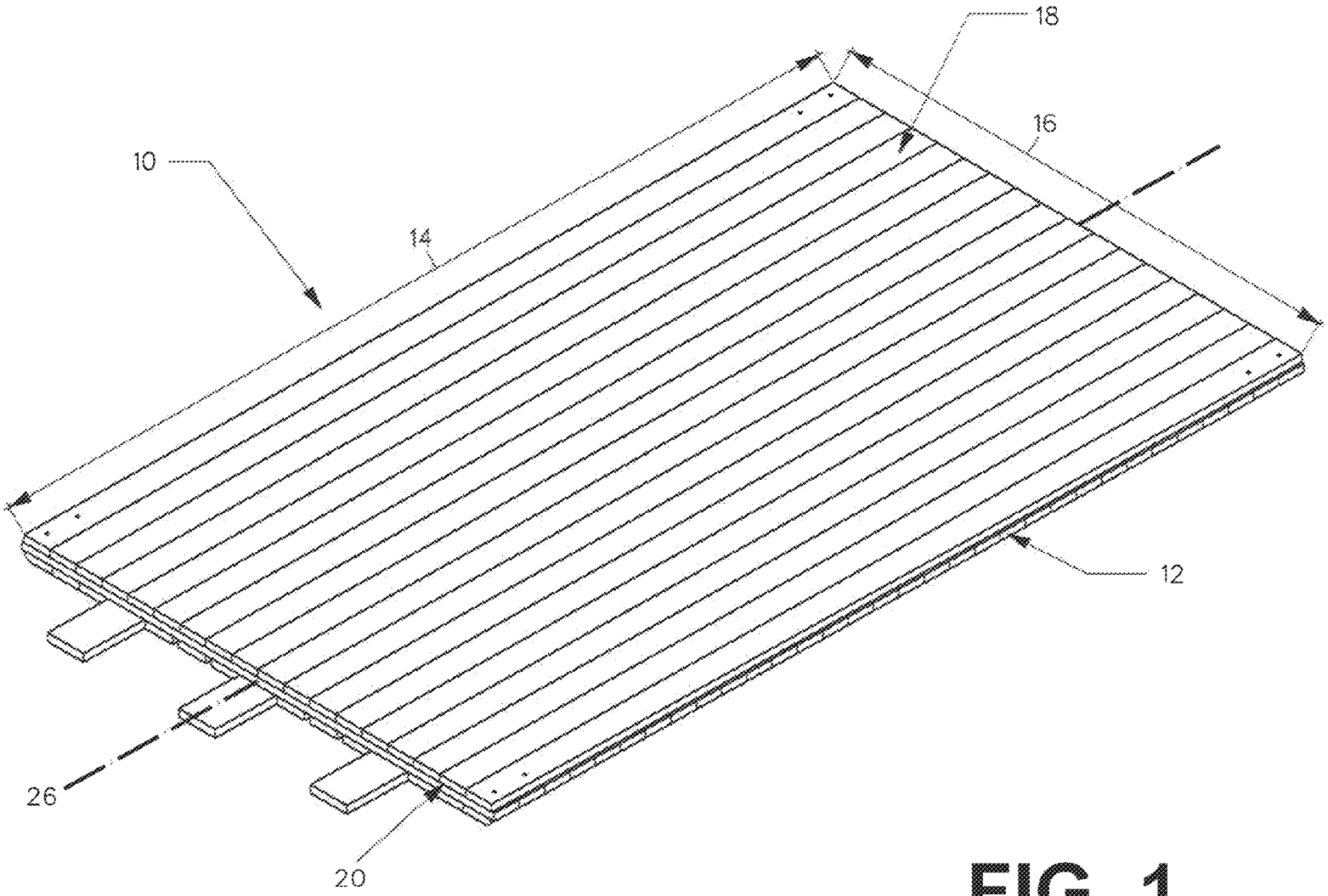
FIG. 1 is a top perspective view of a cross-laminated access mat.

An access mat generally identified by reference numeral 10, will now be described with reference to FIG. 1 through FIG. 8.

Structure and Relationship of Parts

Figure 2:
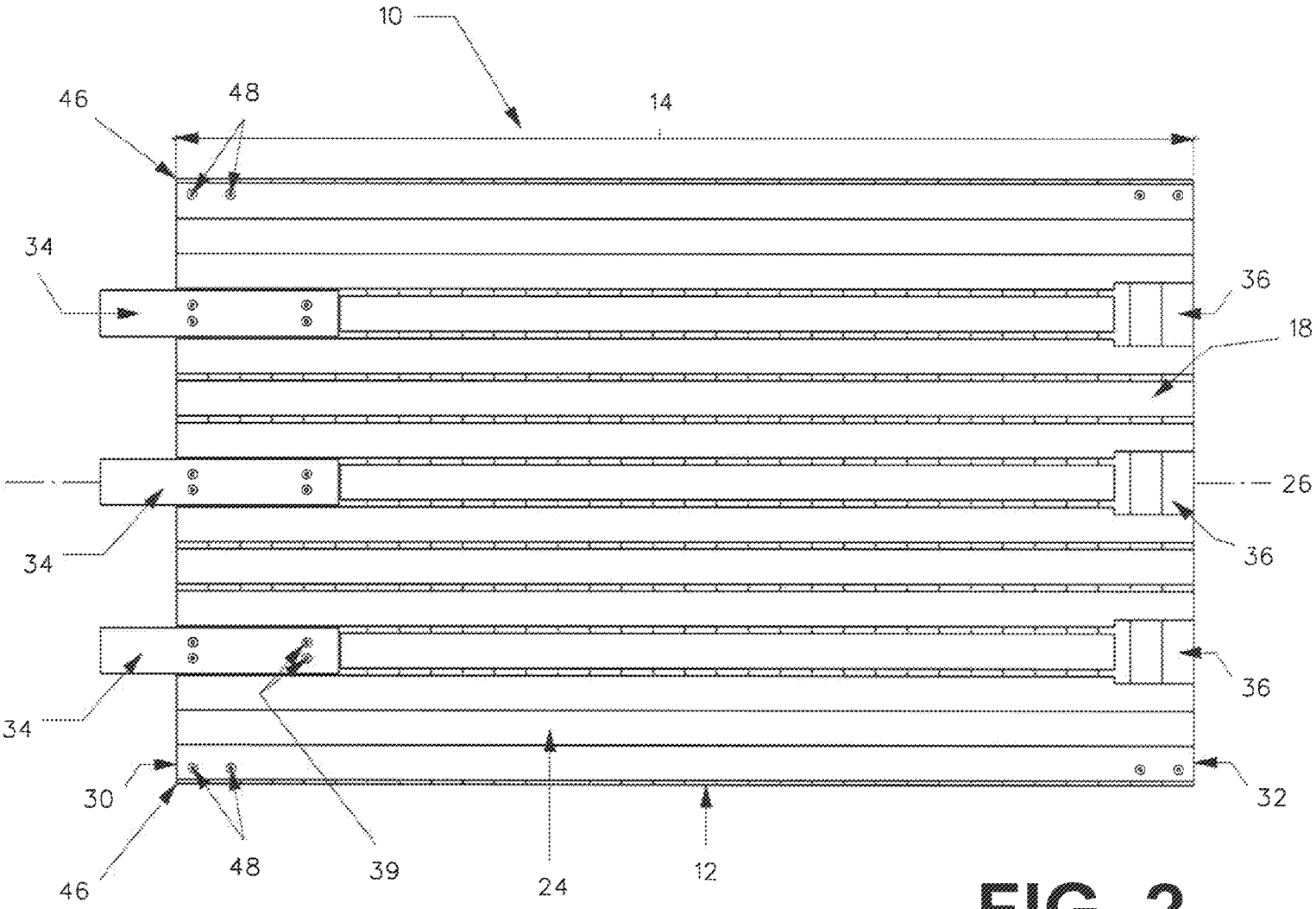
FIG. 2 is a bottom plan view of the access mat illustrated in FIG. 1.
Figure 3:
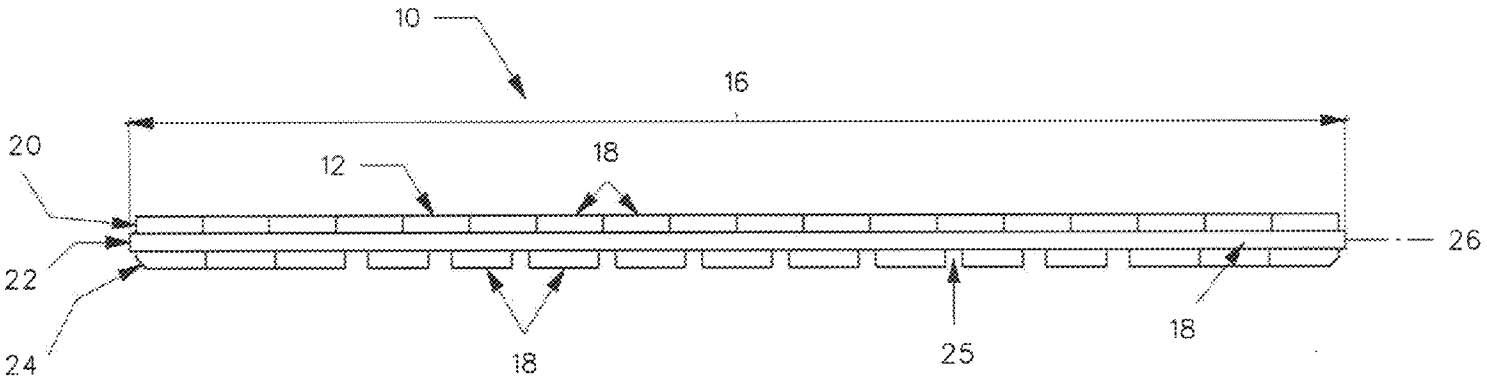
FIG. 3 is a side elevation view of the access mat illustrated in FIG. 1.

Referring to FIG. 1, access mat 10 has a rectangular body 12 having a length dimension indicated by arrow 14 and a width dimension indicated by arrow 16. Referring to FIG. 3, body 12 includes three laminated layers of lumber 18, including: a first layer 20, a second layer 22 and a third layer 24. Referring to FIG. 1, each of lumber 18 has a longitudinal axis 26. Referring to FIG. 1, first layer 20 has a plurality of lumber 18, with longitudinal axis 26 of each lumber 18 in a parallel orientation extending across one of length dimension 14 or width dimension 16. An orientation across length dimension 14 has been illustrated. Referring to FIG. 3, second layer 22 has a plurality of lumber 18 with a longitudinal axis 26 of each lumber 18 in a parallel orientation extending across another of length dimension 14 or width dimension 16. An orientation across width dimension 16 has been illustrated, as first layer 20 was previously illustrated as being oriented across length dimension 14. Referring to FIG. 2, third layer 24 has a plurality of lumber 18 with longitudinal axis 26 of each lumber 18 in an angular orientation relative to longitudinal axis 26 of the plurality of lumber 18 of second layer 22, the layers being laminated together by application of adhesive and pressure. It will be appreciated that a cross-laminated access mat having more than three layers would be viable, but each layer increases weight and at some point additional layers would tend to be redundant. Longitudinal axis 26 of each lumber 18 of the plurality of lumber 18 of second layer 22 is in an orientation that is perpendicular to the orientation of lumber 18 of first layer 20. Similarly, longitudinal axis 26 of each lumber 18 of the plurality of lumber 18 of third layer 24 is in an orientation that is perpendicular to the orientation of lumber 18 of second layer 24. It will be appreciated that another angular orientation, such as 45 degrees, would be viable. However, diagonal orientations would tend to reduce the strength of body 12 and result in a waste of materials during manufacture. Referring to FIG. 3, the plurality of lumber 18 of first layer 20 and the plurality of lumber 18 of second layer 22 are closely spaced. In contrast, the plurality of lumber 18 of third layer 24 are spaced farther apart leaving a clearly discernable gap 25. The reason for this is that it was discovered that removal of access mats 10 from wet and swampy areas could be problematic due to water adhesion. Having lumber 18 of third layer 24 spaced apart with a gap 25 serves to relieve surface tension of the water. It also reduces the weight of the body, as fewer lumber are used.

Figure 4:
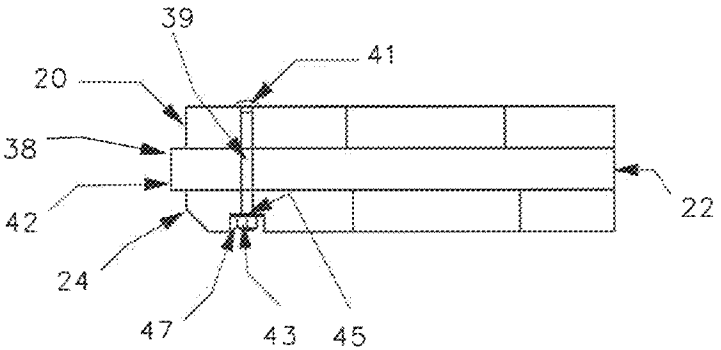
FIG. 4 is a detailed section view of the access mat illustrated in FIG. 2.
Figure 5:
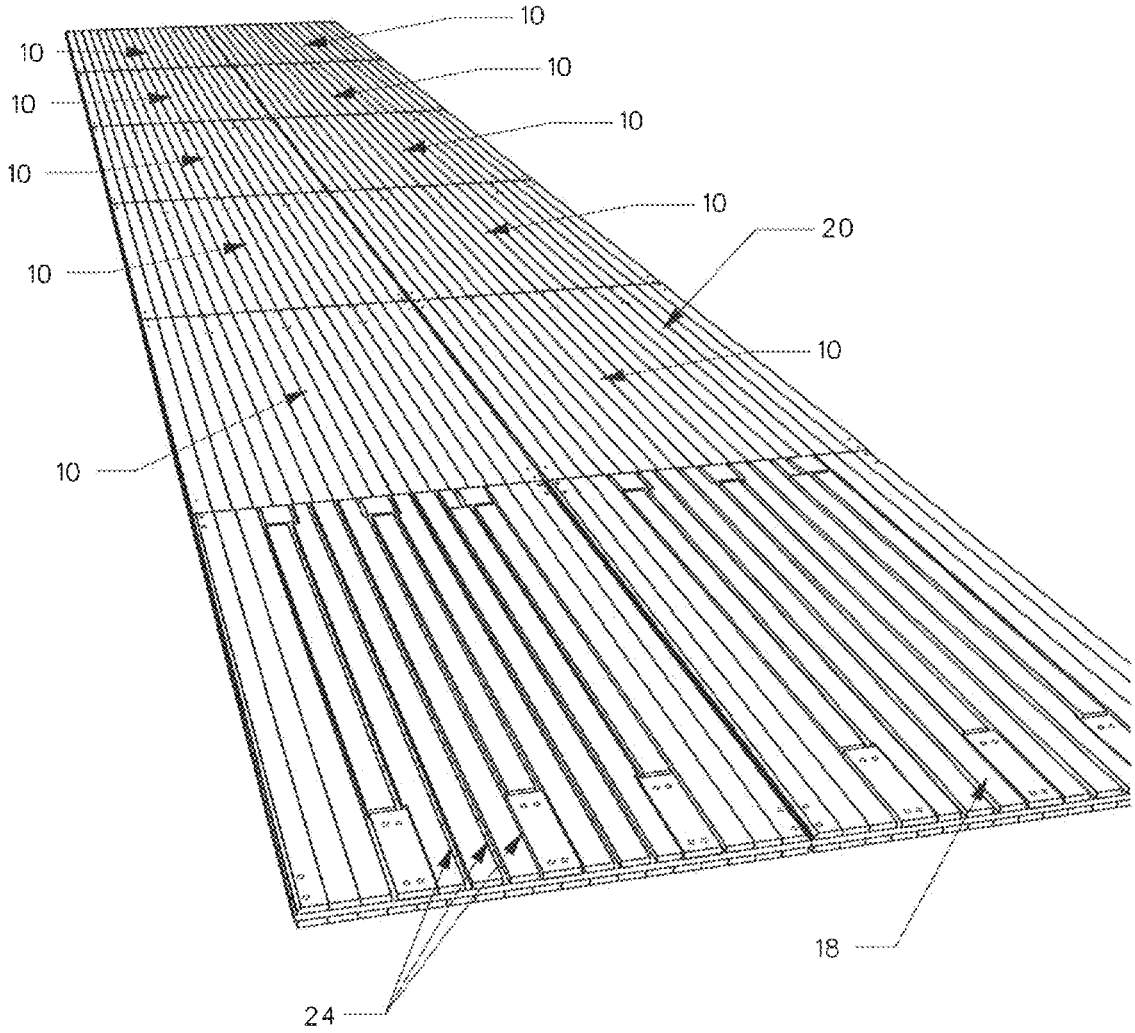
FIG. 5 is a travel surface formed with a plurality of the access mat illustrated in FIG. 1.

Connectors are provided for connecting body 12 with other like bodies. There are various types of connectors that can be used, the form of connectors is not critical. Referring to FIG. 2, body 12 has a first end 30 and a second end 32. One of the connectors is a series of projecting tongues 34, which project past first end 30. Another of the connectors is a series of recessed tongue receivers 36 at second end 32. Referring to FIG. 5, each of projecting tongues 34 of access mat 10 engage one of tongue receivers 36 of another access mat to connect body 12 with other like bodies. Some access mats connect at both the sides and the ends. These access mats are only intended to connect at their respective ends 30 and 32. The sides are allowed to "float" without connection. It will be appreciated that side connectors could be added, if desired or if the application required such side connectors. In FIG. 5, access mat 10 in the foreground has been flipped over, to show the comparative spacing of third layer 24, as compared to the spacing of lumber 18 on first layer 20 for the remaining access mats 10. Referring to FIG. 2, it should be noted that projecting tongues 34 and tongue receivers 36 are positioned in third layer 24 and that third layer 24 is the bottom layer. When the projecting tongues 34 and tongue receivers 36 are positioned in third layer 24, first layer 20 (which is the top layer and the travel surface) is free from any obstruction which might catch during snow removal, serve to accumulate mud or otherwise interfere with movement along the travel surface. Referring to FIG. 2, it is preferred, but not essential, that each of projecting tongues 34 be secured to body 12 by removable fasteners. This is very useful as it enables projecting tongues 34 to be removable to facilitate replacement of damaged projecting tongues 34. If projecting tongues 34 could not be replaced, damage to the projecting tongues 34 could render access mat 10 useless as it could no longer connect with other access mats. It is important to note that access mats 10 are made from cross-laminated lumber and do not require any fasteners. Referring to FIG. 4, fasteners used to secure projecting tongues are bolts 39 having a rounded head 41 and a nut 43 secured at a remote end 45. Remote end 45 and nut 43 are positioned in a recess 47, so that no portion of bolt 39 projects below third layer 24 which serves as the bottom layer.

There are some optional features which may be added to protect access mats from damage during handling. At some sites, access mats 10 are positioned using a piece of equipment referred to as a "button top grapple". The button top grapple is a tracked vehicle that uses pinchers having sharp teeth to grab the mats one each side. Referring to FIG. 4, each layer of body 12 has edges 38. It is preferred that edges 38 of second layer 22 extend outwardly past side edges 38 of first layer 20 and third layer 24 to form a side edge projection 42. The teeth of the pinchers on the button top grapple engage side edge projection 42, and this protects first layer 20 and third layer 24 from sustaining damage to their respective side edges 38.

At other sites, access mats 10 are handled by fork lifts. Fork lift engagements, can sometimes cause corner damage. It is, therefore, preferred that metal elements be positioned at each corner 46 of body 12 to protect body 12 from corner damage. Referring to FIG. 2, the metal elements illustrated are bolts 48 positioned at corners 46, to strengthen corners 46 where fork lift impact may occur. As discussed with reference to bolts 39, bolts 48 are also recessed so that they do not project below third layer 24, which serves as the bottom layer.

Environmental disposal of access mats can be a problem. Especially bolt lumber access mats which may have welded metal frames and 160 to 200 bolts. Apart from four fasteners 38 securing each projecting tongues 34 and four bolts 48 protecting each corner 46, body 12 of access mat 10 has no metal components. Upon removal of bolts 39 securing the projecting tongues and the bolts 48 protecting each corner 46, body 12 can be disposed of on-site through chipping and spreading.

Figure 6:
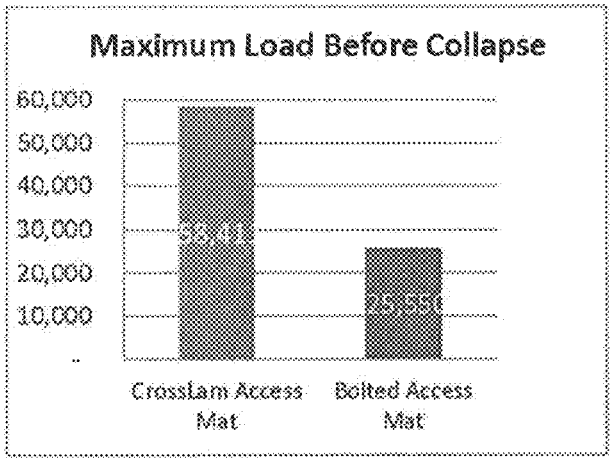
FIG. 6 is a graph providing a maximum load comparison between the access mat of FIG. 1 and a bolted lumber access mat.
Figure 7:
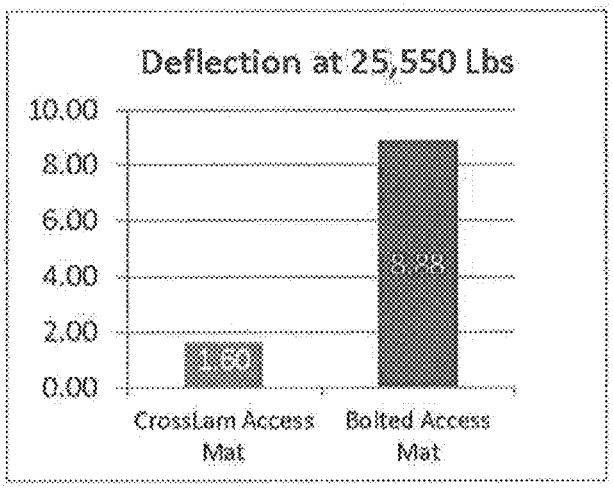
FIG. 7 is a graph providing a deflection comparison between the access mat of FIG. 1 and a bolted lumber access mat.

Comparative Testing Cross-Laminated Access Mats Compared to Bolted Lumber Access Mats Referring to FIG. 6, access mats 10 are more than twice the strength of bolted mats. During testing, access mat 10 collapsed with a weight of 58,411 lbs, while a bolted lumber access mat of the same material crumbled at just 25,550 lbs. Referring to FIG. 7, at the point of collapse, the bolted lumber access mat flexed 8.88", while access mat 10 only flexed a mere 1.60". The tests clearly showed the stiffness and strength of access mat 10 far exceeded that of the bolted lumber access mat.

Figure 8:
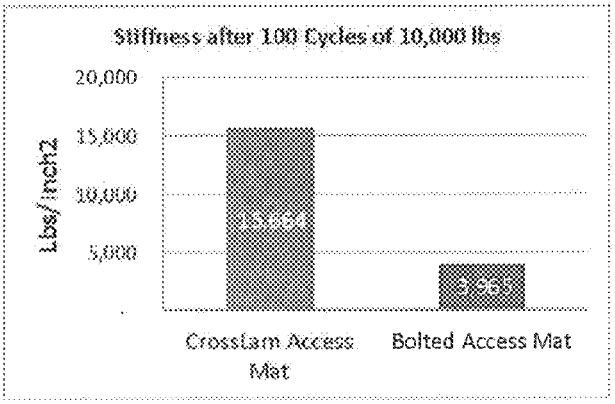
FIG. 8 is a graph providing a stiffness after prolonged use comparison between the access mat of FIG. 1 and a bolted lumber access mat.

Referring to FIG. 8, a further test was conducted to simulate prolonged use. Each of the access mats were tested in third point bending with a span of 144". Each of the access mats was cycled 100 times up to 10,000 lbs. After this abuse, another stiffness test was performed. Both of the access mats were loaded to failure. The maximum load and deflection at maximum load were recorded. The tests showed the comparative deterioration of the access mats over prolonged use, with access mat 10 again outperforming the bolted lumber access mat.

Access mats typically have a 14 foot length and an 8 foot width. As described above, it is preferred that cross-laminated access mats 10 be made from three layers. The lumber is, preferably, kiln dried and made from better quality lumber. The preferred type of lumber is SPF with the travel layer being of Douglas Fir.

When additional layers are added cross-laminated access mats can be used for a different purpose. For example, by adding more layers, access mat could be used to support the weight of a drilling rig or the weight of a crane. The number of layers, from 4 to 9, depend upon the size of the drilling rig or the size of the crane.

Advantages of Cross-Laminated Access Vials Compared to Bolted Lumber Access Mats Access mats 10 provide the following damages, as compared to bolted lumber access mats:

1. Access mats 10 are more than twice as strong.
2. Access mats 10 have more than four times the stiffness.
3. Access mats 10 are better able to maintain stiffness after rigorous use.
4. Access mats 10 maintain shape and do not diamond or deform if mishandled.
5. Access mats 10 have no bolts protruding on the travel layer, so that tire damage due to bolts is eliminated.
6. Access mats 10 have an extended middle layer to minimize damage during installation and removal.
7. Access mats 10 have easy to replace tongues, so that they are not put out of service by tongue damage.
8. Access mats 10 are of cross-laminated lumber and are easily recycled through chipping.
9. Access mats 10 are of relatively light weight, so that freight costs are reduced.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The illustrated embodiments have been set forth only as examples and should not be taken as limiting a purposive interpretation of the claims.

What is claimed is:

1. An access mat, comprising:

a rectangular body having a length dimension and a width dimension, the body having three cross-laminated layers of lumber each of the lumber having a longitudinal axis, a first layer of the three cross-laminated layers having a plurality of lumber with the longitudinal axis of each lumber in a parallel orientation extending across the length dimension, a second layer of the three cross-laminated layers having a plurality of lumber with the longitudinal axis of each lumber in a parallel orientation extending across the width dimension, and a third layer of the three cross-laminated layers having a plurality of lumber with the longitudinal axis of each lumber in an angular orientation relative to the longitudinal axis of the plurality of lumber of the second layer; and connectors for connecting the body with other like bodies.

2. The access mat of claim 1, wherein the longitudinal axis of each lumber of the plurality of lumber of the second layer is in an orientation that is perpendicular to the orientation of the lumber of the first layer.

3. The access mat of claim 1, wherein the longitudinal axis of each lumber of the plurality of lumber of the third layer is in an orientation that is perpendicular to the orientation of the lumber of the second layer.

4. The access mat of claim 1, wherein the plurality of lumber of the first layer, the plurality of lumber of the second layer are closely spaced, and the plurality of lumber of the third layer are spaced farther apart than the plurality of lumber of the first layer and the plurality of lumber of the second layer.

5. The access mat of claim 1, wherein the body has a first end and a second end, with one of the connectors being projecting tongues at one of the first end or the second end and another of the connectors being recessed tongue receivers at another of the first end or the second end, each of the tongues engaging one of the tongue receivers to connect the body with other like bodies.

6. The access mat of claim 5, wherein each of the projecting tongues is secured to the body by removable fasteners, such that the projecting tongues are removable to facilitate replacement of damaged tongues.

7. The access mat of claim 5, wherein each of the projecting tongues and tongue receivers are positioned in the third layer.

8. The access mat of claim 6, wherein, upon removal of the fasteners securing the projecting tongues, the body has no metal components, thereby facilitating on site environmental disposal through chipping.

9. The access mat of claim 1, wherein each layer has a peripheral edge, the peripheral edge of the second layer extending outwardly past the peripheral edge of the first layer and the third layer, thereby protecting the first layer and the third layer from damages to the peripheral edge.

10. The access mat of claim 1, wherein metal elements are positioned at each corner of the body to protect the body from corner damage.

11. The access mat of claim 10, wherein, upon removal of the metal elements from each corner of the body, the body has no metal components, thereby facilitating on site environmental disposal through chipping.

12. An access mat, comprising:

a rectangular body having a length dimension and a width dimension, the body having three to nine cross-laminated layers of lumber, each of the lumber having a longitudinal axis, a first layer having a plurality of lumber with the longitudinal axis of each lumber in a parallel orientation extending across the length dimension, a second layer having a plurality of lumber with the longitudinal axis of each lumber in a parallel orientation extending across the width dimension, and subsequent layers alternating between the orientation of the first layer and the orientation of the second layer; and connectors for connecting the body with other like bodies.

* * * * *